US011278783B1

(12) United States Patent
Morgan

(10) Patent No.: US 11,278,783 B1
(45) Date of Patent: Mar. 22, 2022

(54) HUMAN FORM PUNCHING BAG

(71) Applicant: Kenneth Morgan, Waynesville, GA (US)

(72) Inventor: Kenneth Morgan, Waynesville, GA (US)

( * ) Notice: Subject to any disclaimer, the term of this patent is extended or adjusted under 35 U.S.C. 154(b) by 290 days.

(21) Appl. No.: 16/601,653

(22) Filed: Oct. 15, 2019

(51) Int. Cl.
*A63B 69/34* (2006.01)
*A63B 69/20* (2006.01)
*A63B 69/32* (2006.01)
*A63B 71/06* (2006.01)

(52) U.S. Cl.
CPC ..... *A63B 69/34* (2013.01); *A63B 69/203* (2013.01); *A63B 69/32* (2013.01); *A63B 71/0622* (2013.01); *A63B 2071/0625* (2013.01)

(58) Field of Classification Search
CPC ..... A63B 69/34; A63B 69/004; A63B 69/20; A63B 69/201; A63B 69/24; A63B 69/32; A63B 2071/0626; A63B 2071/0622; A63B 21/0004; A63B 23/0405
See application file for complete search history.

(56) References Cited

U.S. PATENT DOCUMENTS 4,088,315 A 5/1978 Schemmel
5,971,398 A 10/1999 Broussard
6,063,011 A * 5/2000 Pelchat ..... A63B 69/004 482/83
6,155,960 A 12/2000 Roberts
7,887,467 B2 * 2/2011 Booker ..... A63B 69/004 482/83
8,052,582 B2 11/2011 Summers
9,050,514 B1 6/2015 Ayman
D754,794 S 4/2016 Rademacher
10,786,721 B2 * 9/2020 He ..... A63B 69/34
2011/0256990 A1 10/2011 Machado
2014/0221172 A1 * 8/2014 Siklosi ..... A63B 69/34 482/90
2019/0143189 A1 * 5/2019 Elmore ..... A63B 69/004 473/438

FOREIGN PATENT DOCUMENTS

WO 1999056835 11/1999

* cited by examiner

*Primary Examiner* — Megan Anderson
(74) *Attorney, Agent, or Firm* — Kyle A. Fletcher, Esq.

(57) ABSTRACT

The human form punching bag comprises a punching bag and a noise maker. The punching bag may be suspended from above and used for exercise or self-defense training. The human form punching bag may have a torso portion, a right leg portion, and a left leg portion in a humanoid form and may be adapted to be punched or kicked by a user. The intersection of the torso portion, the right leg portion, and the left leg portion may define a groin area. The noise maker may be retained under a flap in the groin area of the punching bag such that a kick administered to the groin area may produce audible feedback.

17 Claims, 5 Drawing Sheets

HUMAN FORM PUNCHING BAG

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of athletic equipment, more specifically, a human form punching bag.

SUMMARY OF INVENTION

The human form punching bag comprises a punching bag and a noise maker. The punching bag may be suspended from above and used for exercise or self-defense training. The human form punching bag may have a torso portion, a right leg portion, and a left leg portion in a humanoid form and may be adapted to be punched or kicked by a user. The intersection of the torso portion, the right leg portion, and the left leg portion may define a groin area. The noise maker may be retained under a flap in the groin area of the punching bag such that a kick administered to the groin area may produce audible feedback.

An object of the invention is to provide a punching bag for exercise and self-defense training.

Another object of the invention is to provide a punching bag having a humanoid form comprising a torso portion, a right leg portion, and a left leg portion.

A further object of the invention is to provide a noise maker in the groin area of the humanoid form punching bag.

Yet another object of the invention is to retain the noise maker under a repositionable flap covering the groin area of the humanoid form punching bag.

These together with additional objects, features and advantages of the human form punching bag will be readily apparent to those of ordinary skill in the art upon reading the following detailed description of the presently preferred, but nonetheless illustrative, embodiments when taken in conjunction with the accompanying drawings.

In this respect, before explaining the current embodiments of the human form punching bag in detail, it is to be understood that the human form punching bag is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the human form punching bag.

It is therefore important that the claims be regarded as including such equivalent construction insofar as they do not depart from the spirit and scope of the human form punching bag. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
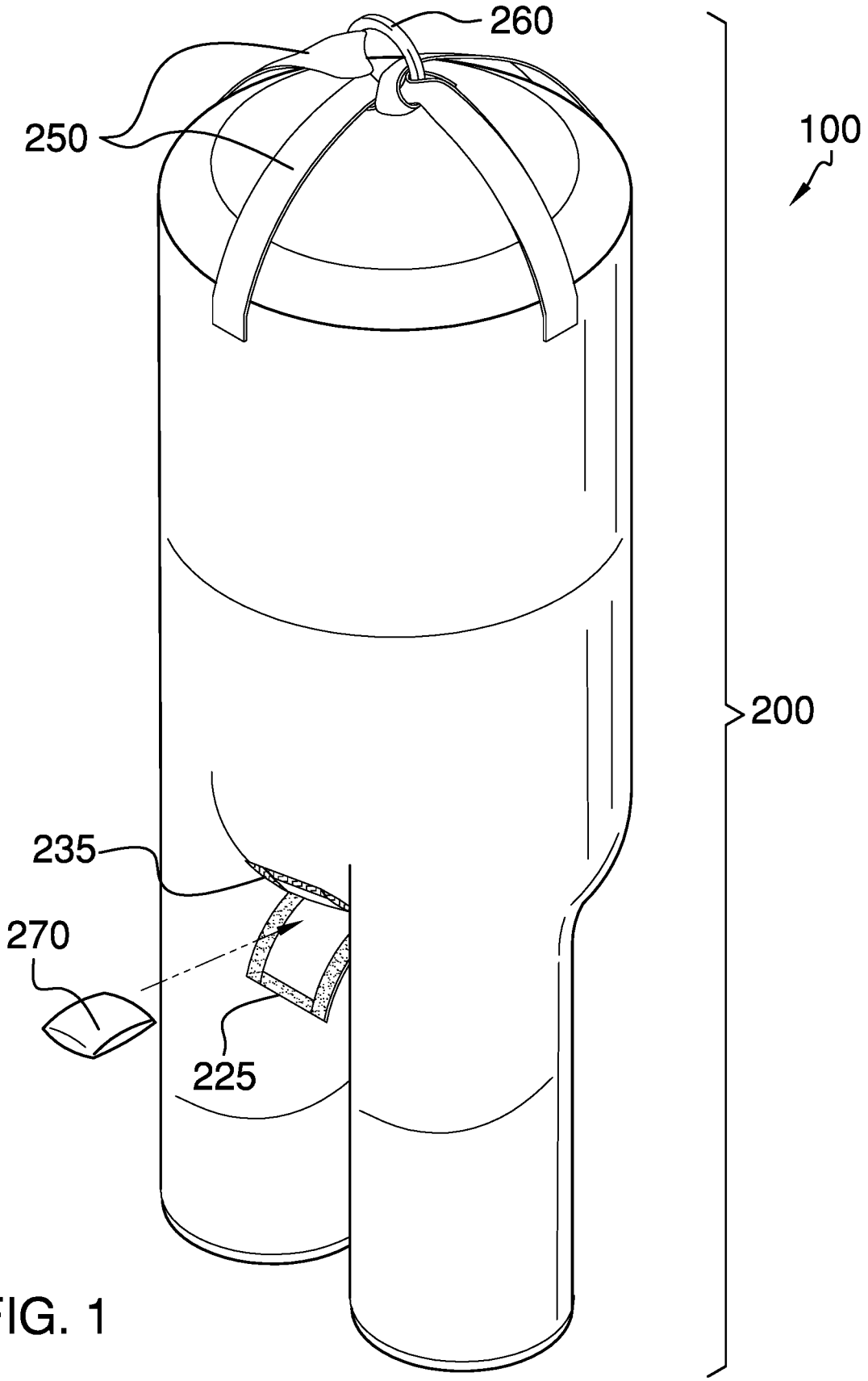
FIG. 1 is a perspective view of an embodiment of the disclosure.
Figure 2:
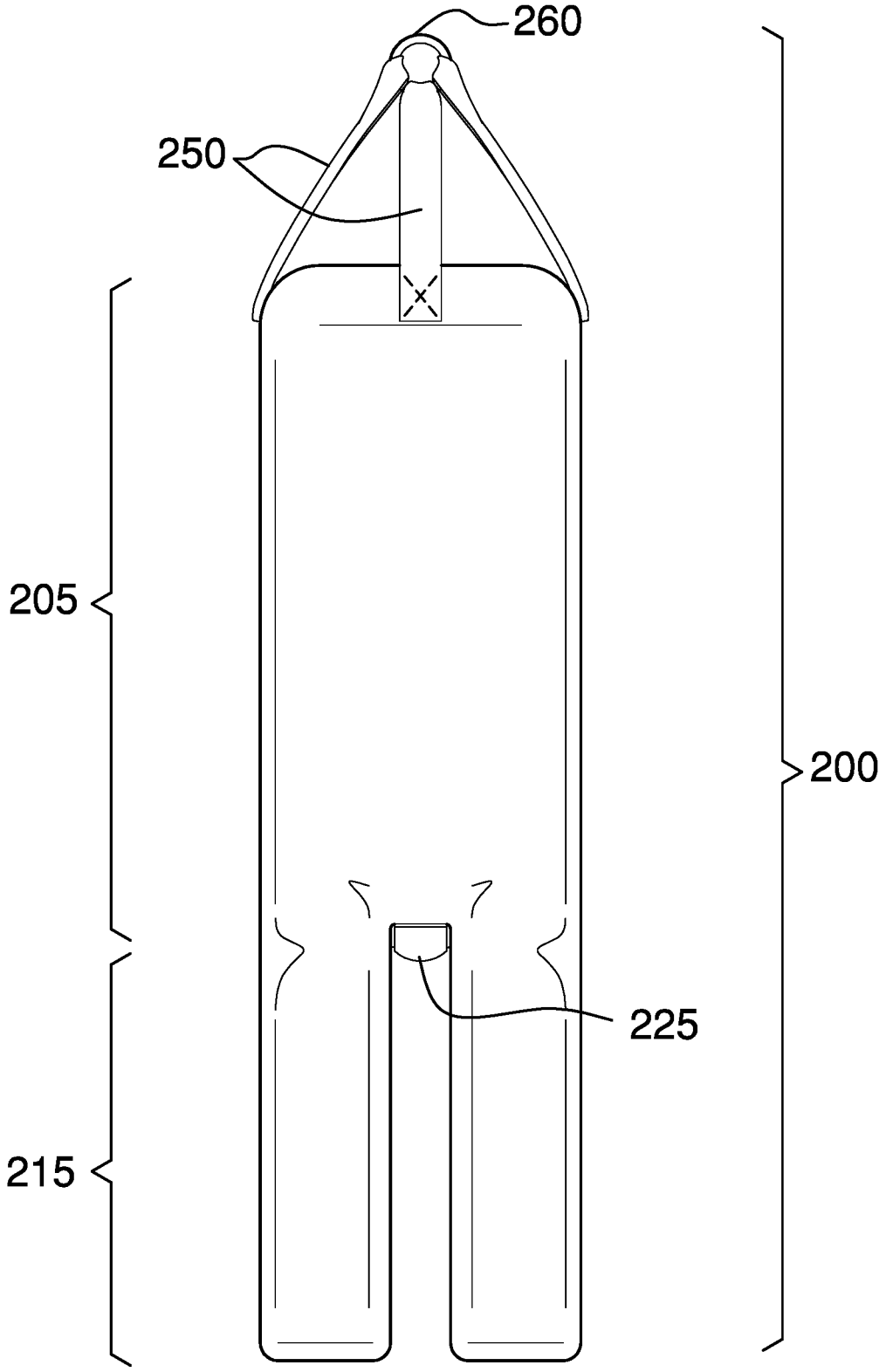
FIG. 2 is a front view of an embodiment of the disclosure.
Figure 3:
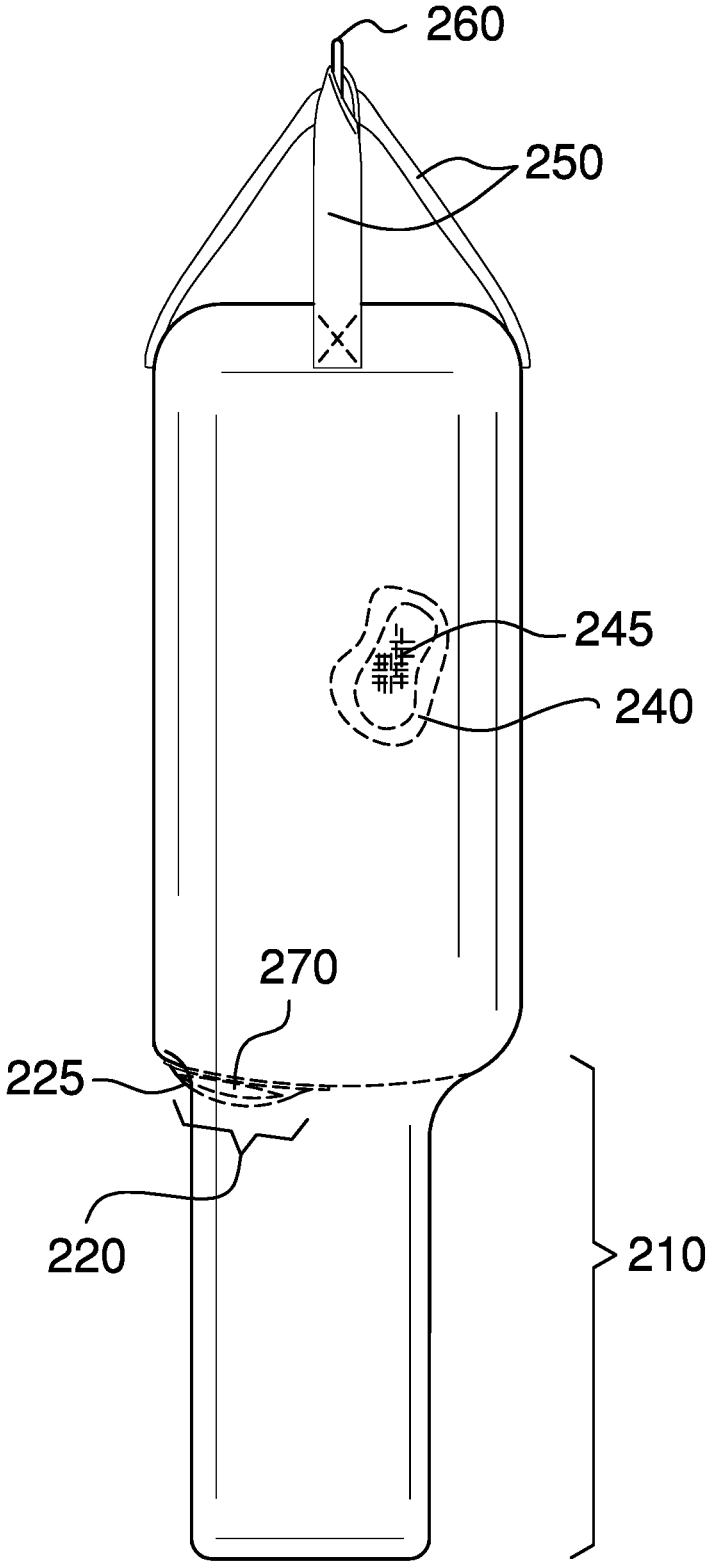
FIG. 3 is a side view of an embodiment of the disclosure.
Figure 4:
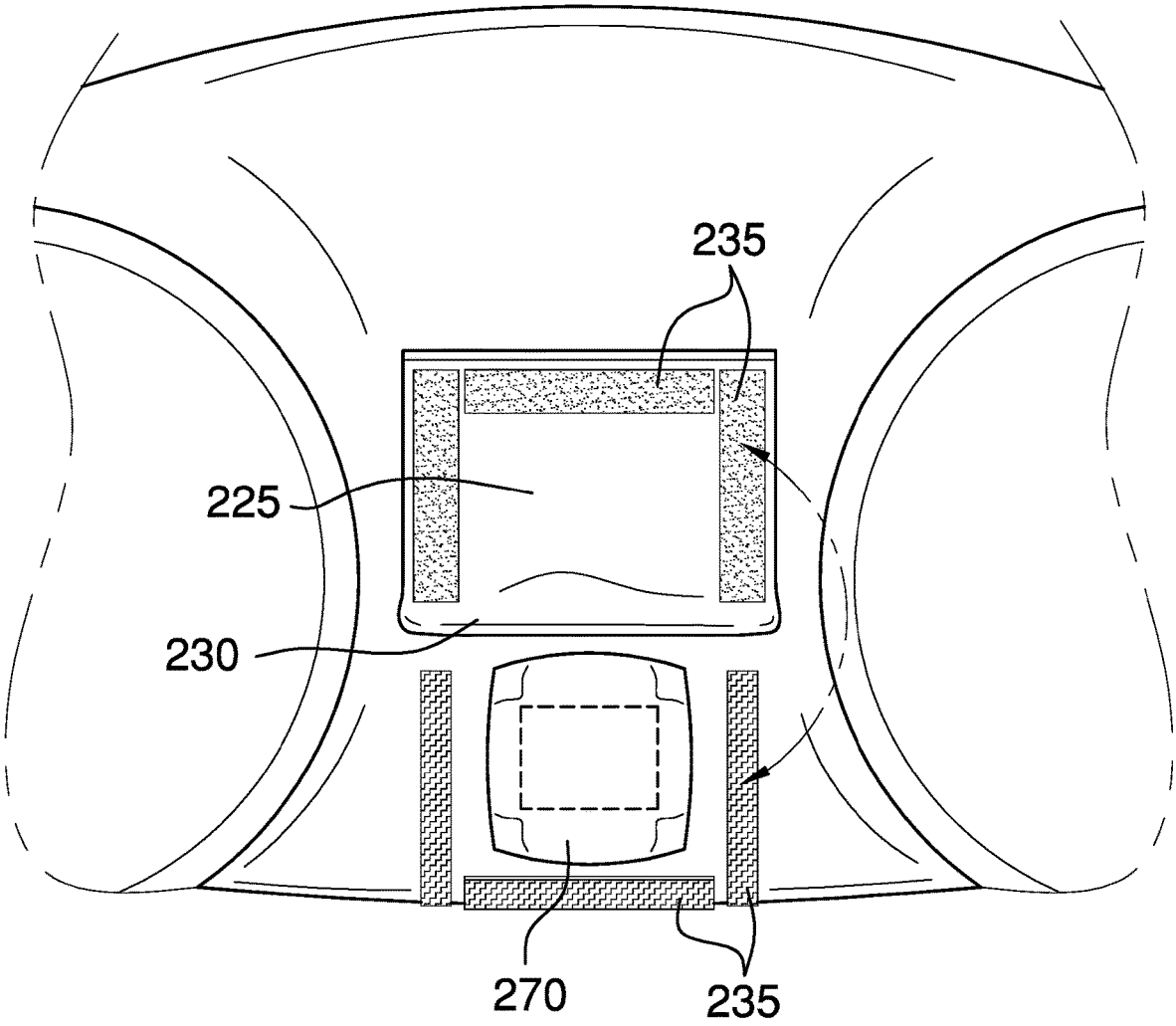
FIG. 4 is a detail view of an embodiment of the disclosure illustrating the retention of the noise maker under a flap in the groin area.
Figure 5:
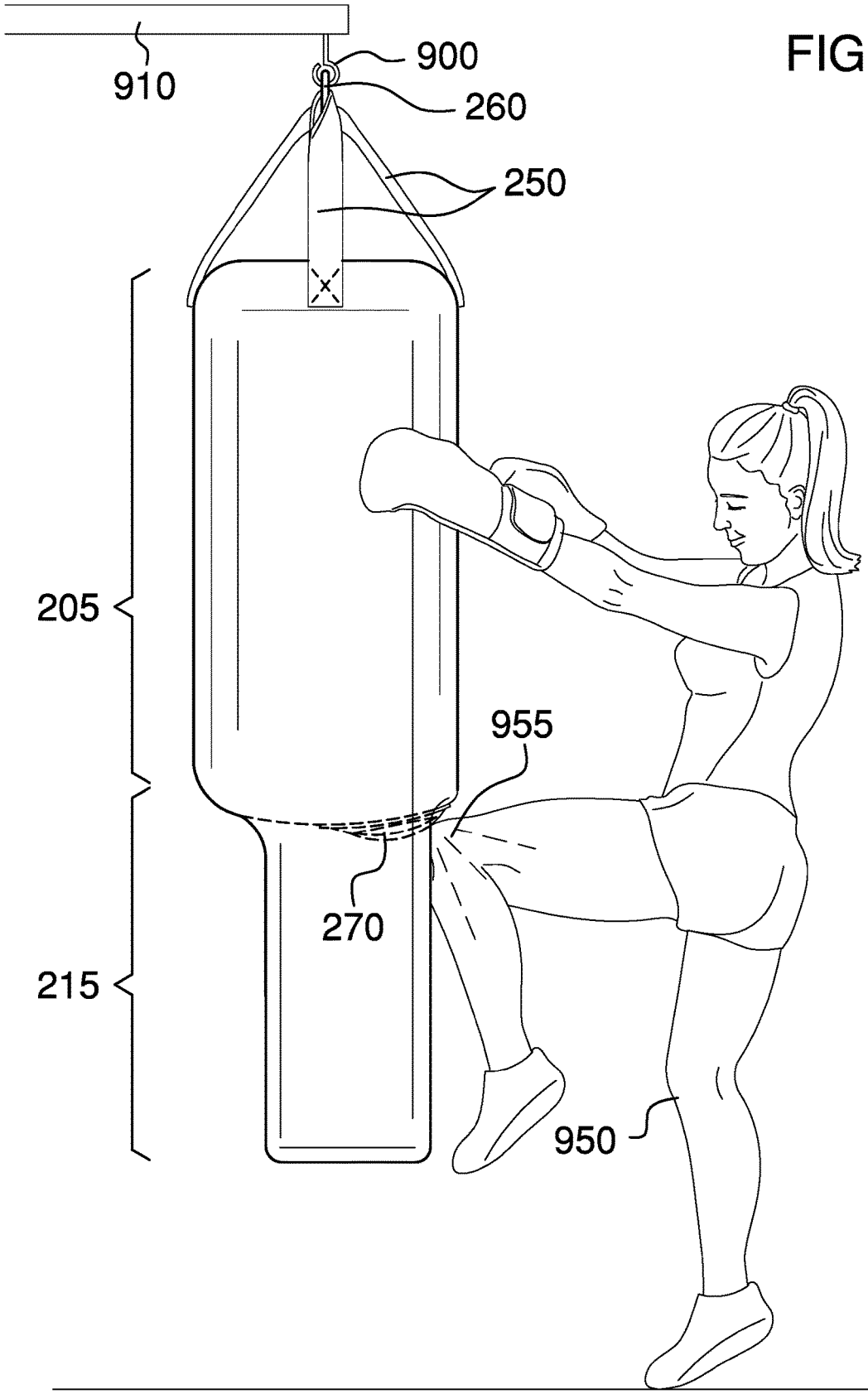
FIG. 5 is an in-use view of an embodiment of the disclosure illustrating a user delivering a knee kick that results in audible feedback.

Detailed reference will now be made to a first potential embodiment of the disclosure, which is illustrated in FIGS. 1 through 5.

The human form punching bag 100 (hereinafter invention) comprises a punching bag 200 and a noise maker 270. The punching bag 200 may be suspended from above and used for exercise or self-defense training. The invention 100 may have a humanoid form and may be adapted to be punched or kicked by a user 950. The noise maker 270 may be located in a groin area 220 of the punching bag 200 such that a kick administered to the groin area 220 may produce audible feedback.

The punching bag 200 may comprise a torso portion 205, a left leg portion 210, a right leg portion 215, a cover flap 225, a plurality of support straps 250, and a ring 260. The torso portion 205 may be a cylindrical upper section of the punching bag 200. The left leg portion 210 and the right leg portion 215 may each be cylindrical lower sections of the punching bag 200. The left leg portion 210 and the right leg portion 215 may be suspended from the bottom of the torso portion 205. The left leg portion 210 and the right leg portion 215 may flank each other. The diameter of the left leg portion 210 may be the same as the diameter of the right leg portion 215. The diameter of the left leg portion 210 and the right leg portion 215 may each be less than or equal to one half of the diameter of the torso portion 205.

The punching bag 200 may be enclosed by a covering 240. As non-limiting examples, the covering 240 may be natural or synthetic leather, vinyl, canvas, or combinations thereof. The covering 240 may be filled with a stuffing material 245. As non-limiting examples, the stuffing material 245 may be grain, sand, rags, saw dust, plastic beads, cardboard, air, water, or combinations thereof.

The groin area 220 located on the lower front of the torso portion 205 between the left leg portion 210 and the right leg portion 215 may be covered by the cover flap 225. The cover flap 225 may be held in place by a seam 230 and a plurality of fasteners 235. The seam 230 may couple one edge of the cover flap 225 to the torso portion 205 and may act as a hinge for the cover flap 225. The plurality of fasteners 235 may removably couple the remaining three edges of the cover flap 225 to the torso portion 205. The plurality of fasteners 235 may be hook and loop fasteners.

The noise maker 270 may create an audible sound when struck with a force that exceeds a predetermined force threshold, exceeds a predetermined strike velocity threshold, or both. The noise maker 270 may be retained at the groin area 220 by the cover flap 225 when the plurality of fasteners 235 are secured. In some embodiments, the noise maker 270 may operate pneumatically by forcing air out of the noise maker 270 during the strike.

The plurality of support straps 250 may suspend the punching bag 200 from the ring 260 located above the punching bag 200. The bottom of an individual strap selected from the plurality of support straps 250 may couple to the top of the torso portion 205. The top of the individual strap may pass through the ring 260 and couple to itself. The plurality of support straps 250 may be equal lengths such that the ring 260 is centered above the punching bag 200.

In use, the punching bag 200 is suspended from a ceiling or a stand 910 by placing the ring 260 over a hook 900. With the punching bag 200 suspended, the user 950 may punch or kick the punching bag 200 for exercise or to practice self-defense skills. The user 950 may kick the invention 100 in the groin area 220 using a knee 955 and may hear audible feedback that the kick was administered correctly if the knee 955 strikes the noise maker 270 and the strike exceeds the predetermined force threshold, exceeds the predetermined strike velocity threshold, or both.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "flap" is a piece of material that is hinged or otherwise attached to a surface using one side such that the piece of material hangs in such a way as to cover a hole in a surface or to provide a barrier between objects.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, the term "grain" refers to the seeds or fruits harvested from a grass.

As used in this disclosure, the "groin" is the area of the body where the thighs join the abdomen.

As used in this disclosure, a "hinge" is a device that permits the turning, rotating, or pivoting of a first object relative to a second object.

As used in this disclosure, a "hook" is an object that is curved or bent at an angle such that items can be hung on or caught by the object or such that the object may be suspended from another object.

As used in this disclosure, a "hook and loop fastener" is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface.

As used in this disclosure, a "seam" is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

As used in this disclosure a "strap" is a strip of leather, cloth, nylon, plastic, thin metal, rubber, or other flexible material, that is used to fasten, secure, carry, or hold onto something. A strap is sometimes used in conjunction with a buckle.

As used in this direction, the "velocity" is a scalar value or a vector that describes the rate of change of position of an object with respect to time (often called speed) and/or the direction of the change of position of the object.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A human form punching bag comprising:

a punching bag and a noise maker;

wherein the punching bag is suspended from above and used for exercise or self-defense training;

wherein the punching bag has a humanoid form and is adapted to be punched or kicked by a user;

wherein the noise maker is located in a groin area of the punching bag such that a kick administered to the groin area produces audible feedback;

wherein the punching bag comprises a torso portion, a left leg portion, a right leg portion, a cover flap, a plurality of support straps, and a ring;

wherein the torso portion is a cylindrical upper section of the punching bag;

wherein the groin area is located on a lower front of the torso portion between the left leg portion and the right leg portion and is covered by the cover flap.

2. The human form punching bag according to claim 1 wherein the left leg portion and the right leg portion are each cylindrical lower sections of the punching bag.

3. The human form punching bag according to claim 2 wherein the left leg portion and the right leg portion are suspended from the bottom of the torso portion.

4. The human form punching bag according to claim 3 wherein the left leg portion and the right leg portion flank each other.

5. The human form punching bag according to claim 4 wherein the diameter of the left leg portion is the same as the diameter of the right leg portion.

6. The human form punching bag according to claim 5 wherein the diameter of the left leg portion and the diameter of the right leg portion are each less than or equal to one half of the diameter of the torso portion.

7. The human form punching bag according to claim 6 wherein the punching bag is enclosed by a covering.

8. The human form punching bag according to claim 7 wherein the covering is filled with a stuffing material.

9. The human form punching bag according to claim 8 wherein the stuffing material is grain, sand, rags, saw dust, plastic beads, cardboard, air, water, or combinations thereof.

10. The human form punching bag according to claim 9 wherein the cover flap is held in place by a seam and a plurality of fasteners;

wherein the seam couples one edge of the cover flap to the torso portion and acts as a hinge for the cover flap;

wherein the plurality of fasteners removably couple the remaining three edges of the cover flap to the torso portion.

11. The human form punching bag according to claim 10 wherein the noise maker creates an audible sound when struck with a force that exceeds a predetermined force threshold, exceeds a predetermined strike velocity threshold, or both.

12. The human form punching bag according to claim 11 wherein the noise maker is retained at the groin area by the cover flap when the plurality of fasteners are secured.

13. The human form punching bag according to claim 12 wherein the noise maker operates pneumatically by forcing air out of the noise maker during the strike.

14. The human form punching bag according to claim 12 wherein the plurality of support straps suspend the punching bag from the ring located above the punching bag;

wherein the plurality of support straps are equal lengths such that the ring is centered above the punching bag.

15. The human form punching bag according to claim 14 wherein the bottom of an individual strap selected from the plurality of support straps couples to the top of the torso portion;

wherein the top of the individual strap passes through the ring and couples to itself.

16. The human form punching bag according to claim 10 wherein the plurality of fasteners are hook and loop fasteners.

17. The human form punching bag according to claim 7 wherein the covering is natural or synthetic leather, vinyl, canvas, or combinations thereof.

* * * * *